US007211158B2

(12) United States Patent
Ishihara et al.

(10) Patent No.: US 7,211,158 B2
(45) Date of Patent: May 1, 2007

(54) PRODUCTION METHOD FOR POWDERED CORE

(75) Inventors: Chio Ishihara, Katsushika-ku (JP); Kazuo Asaka, Matsudo (JP); Kei Ishii, Higashikatsushika-gun (JP); Tamio Takada, Kashiwa (JP); Tsuyoshi Akao, Kariya (JP); Isao Makino, Chiryu (JP)

(73) Assignees: Hitachi Powdered Metals Co., Ltd., Matsudo-shi (JP); Denso Corporation, Kariya-shi (JP)

( * ) Notice: Subject to any disclaimer, the term of this patent is extended or adjusted under 35 U.S.C. 154(b) by 0 days.

(21) Appl. No.: 10/529,733

(22) PCT Filed: Sep. 30, 2003

(86) PCT No.: PCT/JP03/12515

§ 371 (c)(1),
(2), (4) Date: Apr. 12, 2005

(87) PCT Pub. No.: WO2004/030002

PCT Pub. Date: Apr. 8, 2004

(65) Prior Publication Data

US 2005/0242460 A1 Nov. 3, 2005

(30) Foreign Application Priority Data

Sep. 30, 2002 (JP) ..... 2002-285141
Sep. 17, 2003 (JP) ..... 2003-323824

(51) Int. Cl.
*H01F 1/22* (2006.01)
*H01F 1/24* (2006.01)
*H01F 1/28* (2006.01)

(52) U.S. Cl. ..... 148/104; 419/65; 419/64

(58) Field of Classification Search ..... None
See application file for complete search history.

(56) References Cited

U.S. PATENT DOCUMENTS

| | | | | |
|---|---|---|---|---|
| 6,888,435 | B2 * | 5/2005 | Inoue et al. | 336/83 |
| 2003/0047706 | A1 * | 3/2003 | Mitani et al. | 252/62.54 |
| 2003/0127157 | A1 * | 7/2003 | Iyoda et al. | 148/104 |
| 2004/0134566 | A1 * | 7/2004 | Iyoda et al. | 148/105 |

FOREIGN PATENT DOCUMENTS

| | | | |
|---|---|---|---|
| JP | 60-235412 | A | 11/1985 |
| JP | 09-102409 | A | 4/1997 |
| JP | 11-354359 | A | 12/1999 |
| JP | 2000-278951 | A | 10/2000 |
| JP | 2001-155914 | A | 6/2001 |
| JP | 2002-246219 | A | 8/2002 |
| JP | 2002-280209 | A | 9/2002 |
| JP | 2003-183702 | A | 7/2003 |

* cited by examiner

*Primary Examiner*—John P. Sheehan
(74) *Attorney, Agent, or Firm*—Oliff & Berridge PLC

(57) ABSTRACT

The present invention provides a production method for a powdered core, including steps of preparing a mixture including a soft magnetic powder and a resin powder to obtain a mixture, compacting the mixture into a predetermined shape to obtain a green compact and heating the green compact, and wherein the resin powder has a median size of not more than 50 μm, and the resin powder amount is 0.01 to 5 vol %. The method reduces production cost, and decreases eddy-current loss $W_e$ and hysteresis loss $W_h$, whereby a powdered core in which a durability is improved and the technical advantages are expanded can be provided.

7 Claims, 8 Drawing Sheets

PRODUCTION METHOD FOR POWDERED CORE

TECHNICAL FIELD

The present invention relates to a production technique for a powdered core, which is preferably used for electric transformers, reactors, thyristor valves, noise filters, choke coils, and the like, and is more preferably used for motors in which relatively high magnetic flux density is necessary, and solenoid cores (stator cores) for an electromagnetic valve incorporated in an electronically controlled fuel injector in a diesel engine or a gasoline engine.

BACKGROUND ART

Iron loss which is a very important factor for a core used in electric transformers is defined by eddy-current loss which is affected by a resistivity of the core, and hysteresis loss which is affected by strain in a soft magnetic powder, which is generated in a production process of the soft magnetic powder and subsequent processing steps. The iron loss W can be specifically defined by a sum of eddy-current loss $W_e$ and hysteresis loss $W_h$ as shown in the following formula (1). In the formula (1), expression in front of the plus sign is the eddy-current loss $W_e$ and the expression after the plus sign is the hysteresis loss $W_h$. In the formula, "f" is frequency, "$B_m$" is exciting magnetic flux density, "ρ" is resistivity, "t" is material thickness, and "$k_1$" and "$k_2$" are coefficients.

$$W=W_e+W_h=(k_1Bm^2t^2/\rho)f^2+k_2Bm^{1.6}f \quad (1)$$

As shown in the formula (1), while the hysteresis loss $W_h$ is proportional to the frequency f, the eddy-current loss $W_e$ is proportional to the square of the frequency f. Therefore, in order to decrease the iron loss W, specifically in a high frequency area, it is effective to decrease the eddy-current loss $W_e$. In order to decrease the eddy-current loss $W_e$, it is necessary to increase the resistivity ρ by limiting the eddy-current in a small area. In a powdered core obtained by using powders, for example, nonmagnetic resin can exist between iron powder particles, and the like. Therefore, the powdered core has essential characteristics in which the resistivity ρ is high and the eddy-current loss $W_e$ is small. Conventionally, a production technique for a powdered core was proposed in Japanese Laid-open Patent Application No. S60-235412 (pages 1 and 2) in which a mixture of a soft magnetic powder and a resin powder was used, and compacting and heating were performed. In the powdered core described in the above laid-open application, resin existed between soft magnetic powder particles. Therefore, electrical insulation between the soft magnetic powder particles was specifically assured, whereby the eddy-current loss $W_e$ was decreased, and the soft magnetic powders were tightly bound, whereby strength of the powdered core was increased.

The powdered core mentioned above has been widely used because it is easy to produce. However, when the powdered core is used in a high frequency area, the insulation characteristics are not sufficient, whereby the resistivity ρ is decreased, resulting in increasing the eddy-current loss $W_e$. The increase in eddy-current loss $W_e$ causes heat generation, whereby resin binding the soft magnetic powder is deteriorated. Therefore, the powdered core has a disadvantage in that sufficient durability cannot be obtained. On the other hand, when the resin amount is increased in order to increase the electrical insulation, the amount of the soft magnetic powder contained in the core (packing factor) is decreased, whereby the magnetic flux density is decreased. Therefore, it is important to increase the magnetic flux density by increasing the density of the powdered core. However, in this case, the powder must be compressed at a high pressure, and strain is generated in the soft magnetic powder in compacting. Therefore, the hysteresis loss $W_h$ would increase and the iron loss W would increase. Specifically in a low frequency area, the eddy-current loss $W_e$ is small, whereby effect of the hysteresis loss $W_h$ for the iron loss W is large. Decrease in the hysteresis loss $W_h$ is also important in order to decrease the iron loss W.

The powdered core is used for electromagnetic actuators such as solenoids and motors. High attraction power and high responsiveness are required in an electromagnetic valve used for a fuel injector in a diesel engine, and high magnetic flux density and small eddy-current loss $W_e$ in a high frequency area are preferable in stator core materials using the powdered core. These solenoid cores are powdered cores which are obtained by compacting a mixture of iron powder and a resin powder. High density and favorable electrical insulation between iron powder particles are required in the solenoid cores so as to increase the magnetic flux density and to decrease the iron loss.

In various motors, small size and high efficiency are required and high magnetic flux density and small eddy-current loss $W_e$ in a high frequency area are also preferable in a rotor and stator material using a powdered core. Required characteristics for a powdered core used in various electromagnetic actuators are essentially the same as those for a core used in an electric transformer.

In order to obtain a powdered core with high magnetic flux density, high density of the powdered core is necessary, and the compacting pressure must be not less than two times the pressure in producing ordinary sintered alloys. In a powdered core with a complicated shape or a thin wall, the durability of a compacting die assembly would be deteriorated. In a powdered core having a shape similar to a solenoid core, the powdered core compacted to a simple cylindrical or columnar shape is machine finished into a predetermined shape and dimension. Alternately, a powdered core compacted to a shape close to a product shape is machine finished at portions in which dimension accuracy is specifically required. Therefore, the powdered core is required to have excellent machinability, whereby wear of cutting tool can be small and breakage and chipping of the material in machining can be prevented.

A magnetic flux density of the powdered core depends on material density thereof, whereby atomized iron powder in which relatively high density can be obtained is used as an iron power. In a surface of the iron powder, a phosphate compound is coated in order to decrease an iron loss of the powdered core. As resin powders mixed with the iron powder, it is proposed to use phenol, polyamide, epoxy, polyimide or polyphenylene sulfide. For example, Japanese Laid-open Patent No. 2002-246219 (summary) discloses a powdered core obtained by adding a resin selected from polyphenylene sulfide, thermosetting polyimide, and the like at 0.15 to 1 mass % to atomized iron powders coated with phosphate compound. Japanese Patent Publication No. 421944 (section 36) discloses a powdered core obtained by adding a thermosetting polyimide resin at 2 mass % to atomized iron powders coated with phosphate compound.

According to these findings, in order to simultaneously decrease the eddy-current loss $W_e$ and the hysteresis loss $W_h$, various methods for decreasing the eddy-current loss $W_e$ by assuring electrical insulation between the soft magnetic powder particles by preliminarily coating insulation film over the surface of the soft magnetic powders are disclosed, for example, Japanese Laid-open Patent No. H9-102409 (pages 6 and 7). In a technique described in the above laid-open disclosure, a process in which the insulation film is coated on the surface of the soft magnetic powder is essential, thereby having a disadvantage of having high production cost. Recently, it has been requested to develop the production method for a powdered core in which low production cost can be realized, the eddy-current loss $W_e$ and the hysteresis loss $W_h$ are decreased, and durability of the powdered core can be improved.

In the solenoid core made of the above-mentioned powdered core, higher magnetic flux density and smaller iron loss are required. Furthermore, when the solenoid core is machined (including drilling) for shaping and assuring the dimension accuracy thereof, it is required to have enough strength to withstand chucking and without breakage, peeling, and chipping in the machining process.

The present invention has been made to essentially realize low production cost without performing special processes including coating of insulation film. A object of the present invention is to provide a production method for a powdered core, in which electrical insulation is increased by uniformly disposing a resin between soft magnetic powder particles, whereby the eddy-current loss $W_e$ in a high frequency area and heat generation caused by the $W_e$ are decreased, thereby improving the durability of the powdered core and improving performance of products using the powdered core. Another object of the present invention is to provide a production method for a powdered core, in which magnetic flux density is sufficiently assured by thinly disposing the resin between the soft magnetic powder particles, whereby the hysteresis loss $W_h$ and heat generation caused by the $W_h$ are decreased, thereby further improving the durability of the powdered core and improving performance of products using the powdered core. In the case of coating the insulation film over the surface of the soft magnetic powder in the present invention, there is an additional object that the electrical insulation is assured at higher levels and the magnetic flux density is further increased by decreasing the resin amount used, whereby the durability of the powdered core is further improved.

DISCLOSURE OF THE INVENTION

The inventors have intensively researched so as to solve the above-mentioned problems. As a result, the inventors have found that electrical insulation sufficient to assure an adequate durability of a powdered core cannot be obtained in the conventional powdered core, since the resin is nonuniformly disposed in the obtained powdered core, that is, the resin is not uniformly disposed between the soft magnetic powder particles. The inventors have researched regarding the above-mentioned phenomenon by specifically giving attention to the particle size of the resin powder to assure the electrical insulation, and have found the following findings. That is, when resin powder having a conventional median size (particle diameter at 50% of cumulative distribution) of about 100 μm is used, the resin powders have been nonuniformly disposed in the powdered core under a compacted condition, whereby even if thermoplastic resin powder is used, the resin powder is not sufficiently infiltrated between the soft magnetic powder particles, resulting in the resin powder remaining in a nonuniform condition. Therefore, the inventors have found that if the resin powders are uniformly dispersed in the soft magnetic powder particles in compacting, the resin is uniformly disposed between the soft magnetic powder particles after a heat treatment, whereby the electrical insulation is assured. The inventors have further researched according to the above-mentioned findings. As a result, the inventors found that when a resin powder having small median size is used, the resin powders can be easily disposed between the soft magnetic powder particles, whereby a powdered core in which the resin is uniformly disposed between the soft magnetic powder particles after the heat treatment can be obtained.

A production method for a powdered core of the present invention includes steps of preparing a mixture including a soft magnetic powder and a resin powder, compacting the miture into a predetermined shape to obtain a green compact, and heating the green compact, wherein the resin powder has a median size of not more than 50 μm, and the resin powder amount is 0.01 to 5 vol %.

In the present invention, a special treatment to coat an insulation film over the surface of the soft magnetic powder is not necessary, unlike in the case of a powdered core described in Japanese Laid-open Patent No. H9-102409, whereby low production cost can be realized. In the present invention, as mentioned above, a resin powder having a median size of not more than 50μm is used, whereby electrical insulation is increased by uniformly disposing the resin between the soft magnetic powder particles, and the eddy-current loss $W_e$ in a high frequency area and heat generation caused by the $W_e$ are decreased, thereby improving the durability of the powdered core and improving the performance of products using the powdered core. In the present invention, the resin powder amount is 0.01 to 5 vol %. By setting the resin powder amount to be not less than 0.01 vol %, sufficient electrical insulation is assured, whereby the eddy-current loss $W_e$ in high frequency area and heat generation caused by the $W_e$ are decreased, thereby further improving the durability of the powdered core and improving the performance of products using the powdered core.

On the other hand, by setting the resin powder amount to be not more than 5 vol %, magnetic flux density is sufficiently assured by thinly disposing the resin between the soft magnetic powder particles, whereby the hysteresis loss $W_h$ and heat generation caused by the $W_h$ are decreased, thereby further improving the durability of the powdered core. In the production method for a powdered core of the present invention, low production cost is realized without performing special treatments on the soft magnetic powder, and improvement of the durability of the powdered core is realized by improvement of the median size and amount of the resin powder used.

In the present invention, conventional resins which are added to a powdered core can be used. For example, phenol resins, polyamide resins, epoxy resins, thermosetting polyimide resins, thermoplastic polyimide resins, polyphenylene sulfide, polytetrafluoroethylene, and so on can be used. Polyimide resin and the like can be used in the case of application in which heat resistance is required, and inexpensive epoxy resin and the like can be used in the case of applications other than the above-mentioned application.

An insulation coating treatment is not required for a soft magnetic powder used in the production method of the present invention, and conventional soft magnetic powders can be sufficiently used. In the case of coating an insulation film over the surface of the soft magnetic powder, the electrical insulation is assured at a higher level and the magnetic flux density is further increased by decreasing the resin amount used, whereby a powdered core in which the durability is further improved can be provided. In the case of using a soft magnetic powder having a median size which is too small, the specific surface area of the soft magnetic powder is increased, thereby decreasing the electrical insulation. Therefore, a soft magnetic powder having a median size of not less than 50 μm is preferably used.

In the mixing of the resin powder and the soft magnetic powder, conventional means can be used. Even if both powders are simply mixed, the resin powder can be uniformly disposed between the soft magnetic powder particles, whereby the electrical insulation can be sufficiently ensured. When the resin powder is uniformly dispersed in a solvent by a dispersant to obtain a solution and the soft magnetic powder is misted with the solution and is dried, the resin is more uniformly disposed between the soft magnetic powder particles, thereby obtaining higher electrical insulation.

In the above-mentioned production method for a powdered core, a thermoplastic resin is preferably used as a resin powder, because the resin melted by heating is easily infiltrated between the soft magnetic powder particles. When a thermosetting resin is used as a resin powder, the resin is not easily infiltrated between the soft magnetic powder particles, whereby the resin becomes hardened in an area in which the resin exists in compacting. In order to obtain much higher electrical insulation, a thermosetting resin powder having a much smaller particle size in median size of not more than 30 μm is preferably used.

When a powdered core having high magnetic flux density such as a solenoid core is produced, the following embodiment is preferable.

When a thermosetting polyimide resin powder is used as a resin powder, the resin amount is preferably not less than 0.18 vol % in order to obtain a powdered core having low iron loss, and is preferably not more than 2.4 vol % in order to avoid to decrease the magnetic flux density caused by low green density along with high the resin amount even in the case of high compacting pressure. The specific gravity of an ordinary iron powder used as a soft magnetic powder is 7.87 and the specific gravity of the thermosetting polyimide resin powder is 1.30, whereby the above-mentioned amount is converted into 0.03 to 0.4 mass %. In this case, when the median size of the thermosetting polyimide resin powder is not more than 50 μm, powdered cores having an equivalent iron loss can be obtained. A median size of the thermosetting polyimide resin powder is preferably not more than 30 μm judging from the above-mentioned hardening characteristics of the thermosetting resin.

When a thermoplastic polyimide resin powder is used as a resin powder, in order to obtain a powdered core having low iron loss, the powder amount is preferably not less than 0.59 vol % in the case in which the median size is not more than 50 μm, and the powder amount is preferably not less than 0.18 vol % in the case in which the median size is not more than 13 μm. The powder amount is preferably not more than 2.4 vol % in order to assure high green density. A specific gravity of the thermoplastic polyimide resin powder is 1.33, whereby the above-mentioned amount is converted into 0.1 to 0.4 mass % in the case in which the median size is not more than 50 μm and is converted into 0.03 to 0.4 mass % in the case in which the median size is not more than 13 μm.

When the polytetrafluoroethylene is used as a resin powder, in order to obtain a powdered core having low iron loss, the powder amount is preferably not less than 0.36 vol % in the case in which the median size is not more than 10 μm, and the powder amount is preferably not less than 0.11 vol % in the case in which the median size is not more than 5 μm. The powder amount is preferably not more than 1.4 vol % in order to obtain high green density in which higher magnetic flux density is assured. The specific gravity of the polytetrafluoroethylene is 2.2, whereby the above-mentioned amount is converted into 0.1 to 0.4 mass % in the case in which the median size is not more than 10 μm and is converted into 0.03 to 0.4 mass % in the case in which the median size is not more than 5 μm. A powder having a median size of not more than 3 μm is advantageously and easily obtained due to a large amount of the powder which is commercially available.

Iron powder like atomized iron powder is preferably used as a soft magnetic powder, phosphate compound is more preferably coated on the surface of the iron. The iron and the resin powder mentioned above are mixed to obtain a mixture, the mixture is compacted at a compacting pressure of 700 to 2000 MPa to obtain a green compact, and a heat treatment is performed on the green compact to obtain a heat-treated compact. After the heat treatment, the heat-treated compact is machine finished into a predetermined shape according to need.

In this case, it is preferable to apply a lubricant powder for compacting to a compacting die assembly without adding a lubricant powder for compacting to the mixture in compacting. When a lubricant powder for compacting is added to the mixture, the green density is possibly decreased and defects in the powdered core are possibly generated by heating in the heat treatment. Zinc stearate is electrostatically applied to a wall surface of the compacting die assembly, whereby the mixture is easily compacted and the powdered core is easily ejected from the compacting die assembly. When a thermosetting resin is used as a resin powder, the temperature in the heat treatment is preferably 150 to 400° C. When a thermoplastic resin is used as a resin powder, a temperature in the heat treatment is preferably 320 to 450° C.

As cutting works, for example, cutting by a lathe, drilling, cutting by a milling cutter, and cutting by an end milling can be applied. In producing a powdered core having a thin wall or a complicated shape, it is preferable to perform the cutting works, whereby a solenoid core used in a fuel injector in an engine can be produced.

BEST MODE FOR CARRYING OUT THE INVENTION

PRACTICAL EXAMPLE 1

Figure 1:
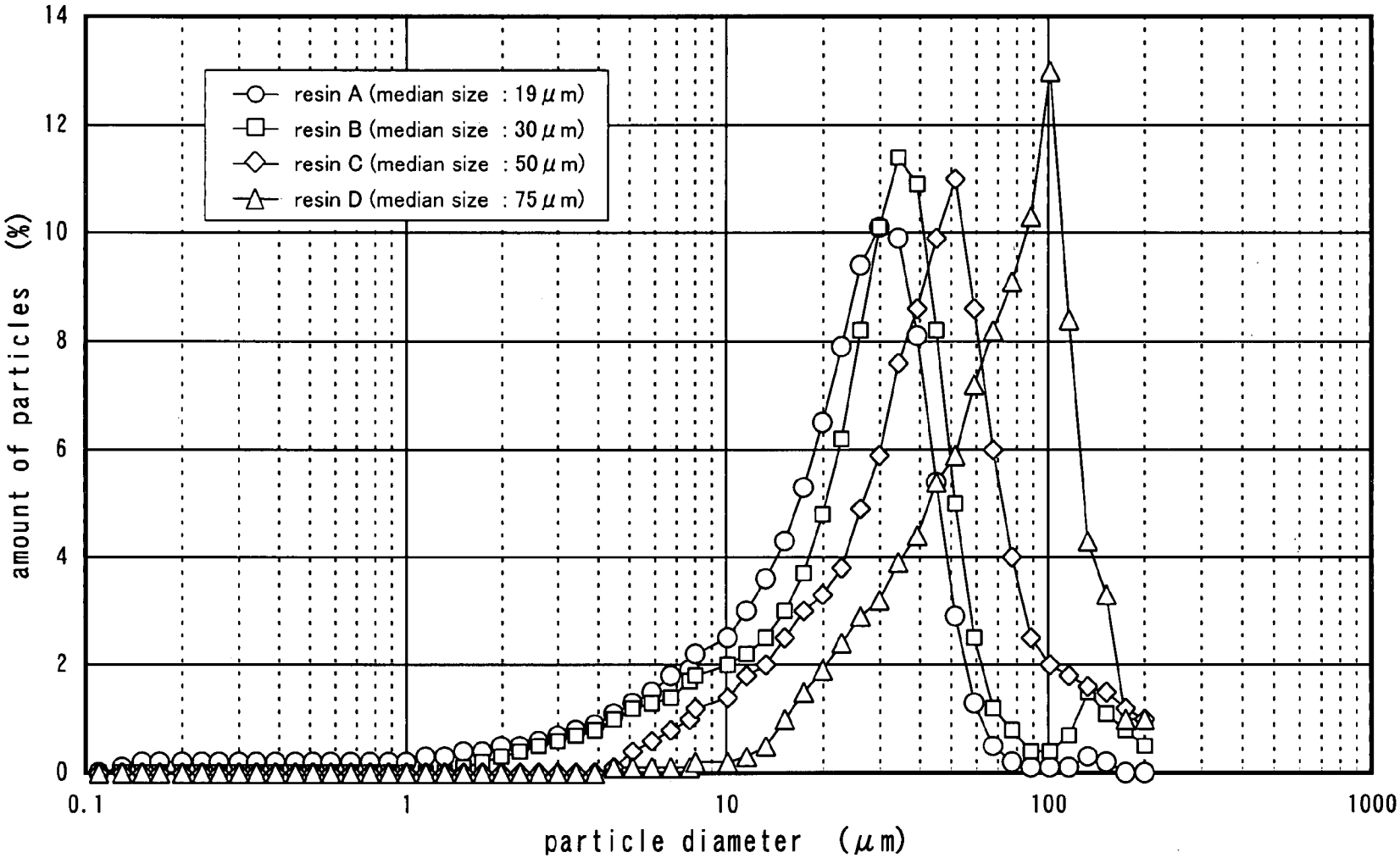
FIG. 1 is a graph showing relationships between amount of particles and particle diameter for 4 kinds of resins A to D.

4 kinds of thermosetting polyimide resins A to D having a specific particle size and median size were prepared. In these resins, the resins A to C were respectively suitable for a production method of the present invention, and the resin D was a conventional type which was not suitable for a production method of the present invention. Each resin A to D was added at 1.75 vol % to electrically insulated iron powder coated with phosphate, and the resin and the iron powder were mixed, whereby a mixture was respectively produced. These mixtures were compacted at a compacting pressure of 980 MPa to obtain green compacts having a ring shape in which the inner diameter was 20 mm, the outer diameter was 30 mm, and the height was 5 mm, and these green compacts were heated and held at 200° C. for 5 hours, whereby powdered cores were produced.

By using each powdered core having the ring shape as produced above, eddy-current loss $W_e$ and hysteresis loss $W_h$ were respectively measured in a range at a exciting magnetic flux density of 0.05 to 1 T and a frequency of 50 to 2000 Hz. The results are shown at Table 1, FIG. 2 and FIG. 3. A result of iron loss W obtained by adding the $W_e$ to $W_h$ is shown at Table 1 and FIG. 4. SEM images and EPMA images concerning the powdered core obtained by using the resin A (Invention Example) and the powdered core obtained by using the resin D (Conventional Example) were taken, whereby distribution condition of carbon (resin) was examined in the shot field. FIG. 5A is a SEM image of an Invention Example, FIG. 5B is an EPMA image of an Invention Example, FIG. 5C is a SEM image of a Conventional Example, and FIG. 5D is an EPMA image of a Conventional Example. In the SEM images, particle boundary and resin are shown in black portions, and in the EPMA images, carbon included in the resin is shown in white portions.

TABLE 1

| measured characteristic | resin type | frequency (Hz) 50 | 60 | 100 | 200 | 500 | 1000 | 1500 | 2000 |
|---|---|---|---|---|---|---|---|---|---|
| eddy-current loss We (W/kg) | resin A | 0.01 | 0.02 | 0.04 | 0.17 | 1.10 | 4.43 | 9.66 | 17.16 |
| | resin B | 0.08 | 0.11 | 0.30 | 1.21 | 7.82 | 28.31 | 49.00 | 82.00 |
| | resin C | 0.09 | 0.13 | 0.35 | 1.41 | 7.98 | 34.50 | 78.00 | 134.00 |
| | resin D | 0.19 | 0.26 | 0.74 | 2.98 | 18.81 | 75.40 | 169.77 | 291.19 |
| hysteresis loss Wh (W/kg) | resin A | 7.13 | 8.41 | 14.10 | 27.88 | 72.00 | 141.80 | 211.30 | 275.00 |
| | resin B | 6.91 | 8.30 | 13.84 | 27.49 | 71.15 | 141.27 | 210.13 | 274.46 |
| | resin C | 7.21 | 8.35 | 14.20 | 27.80 | 72.30 | 142.10 | 213.00 | 278.00 |
| | resin D | 7.28 | 8.48 | 14.66 | 29.33 | 74.17 | 148.63 | 223.11 | 287.00 |
| iron loss W (W/kg) | resin A | 7.14 | 8.43 | 14.14 | 28.05 | 73.10 | 146.23 | 220.96 | 292.16 |
| | resin B | 6.98 | 8.41 | 14.14 | 28.69 | 78.97 | 169.58 | 259.13 | 356.46 |
| | resin C | 7.30 | 8.48 | 14.55 | 29.21 | 80.28 | 176.60 | 291.00 | 412.00 |
| | resin D | 7.47 | 8.74 | 15.41 | 32.30 | 92.99 | 224.03 | 392.87 | 578.19 |

Figure 2:
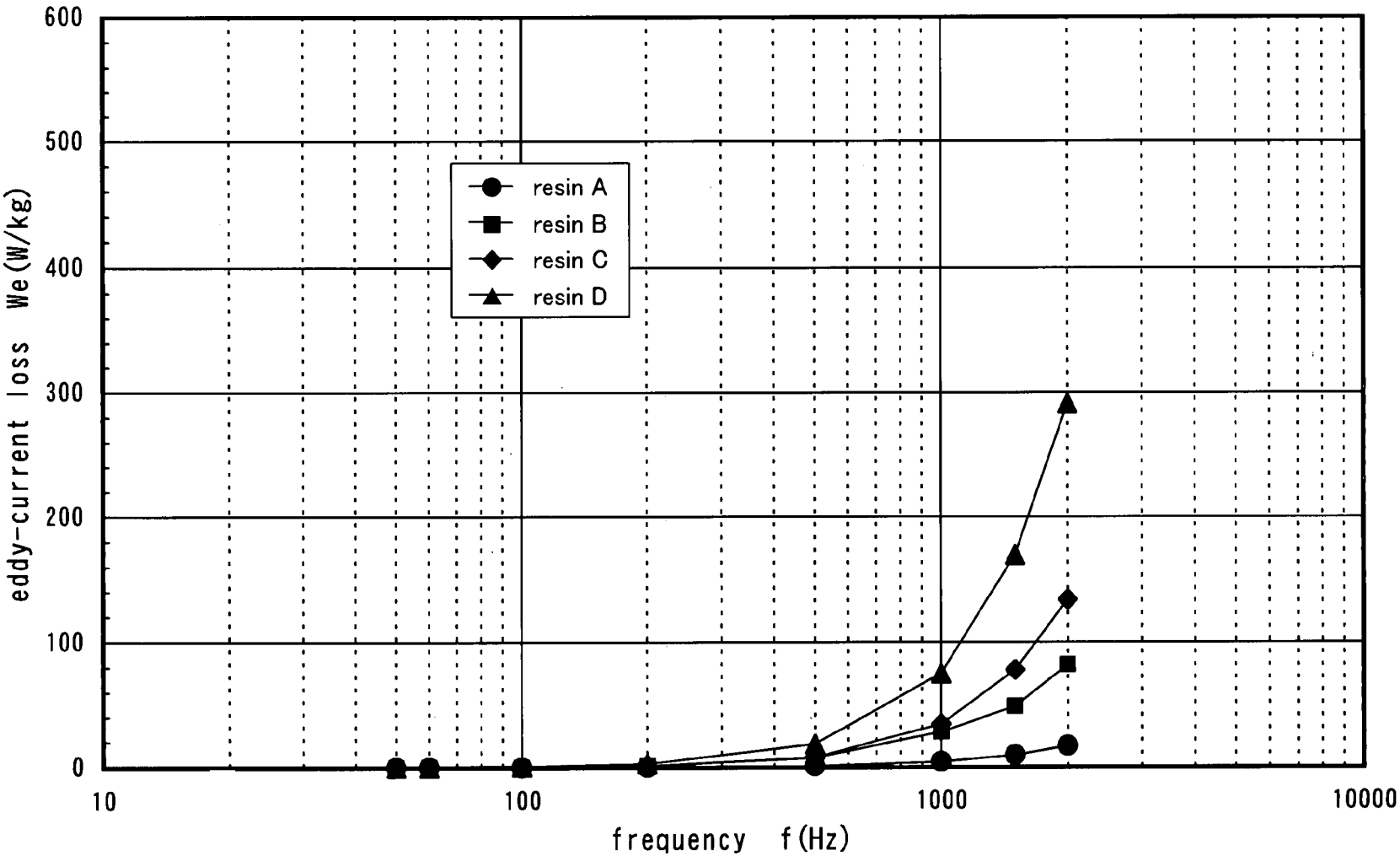
FIG. 2 is a graph showing relationships between eddy-current loss $W_e$ and frequency f concerning powdered cores produced by adding the 4 kinds of resins A to D described in the FIG. 1 to electrically insulated iron powder.
Figure 3:
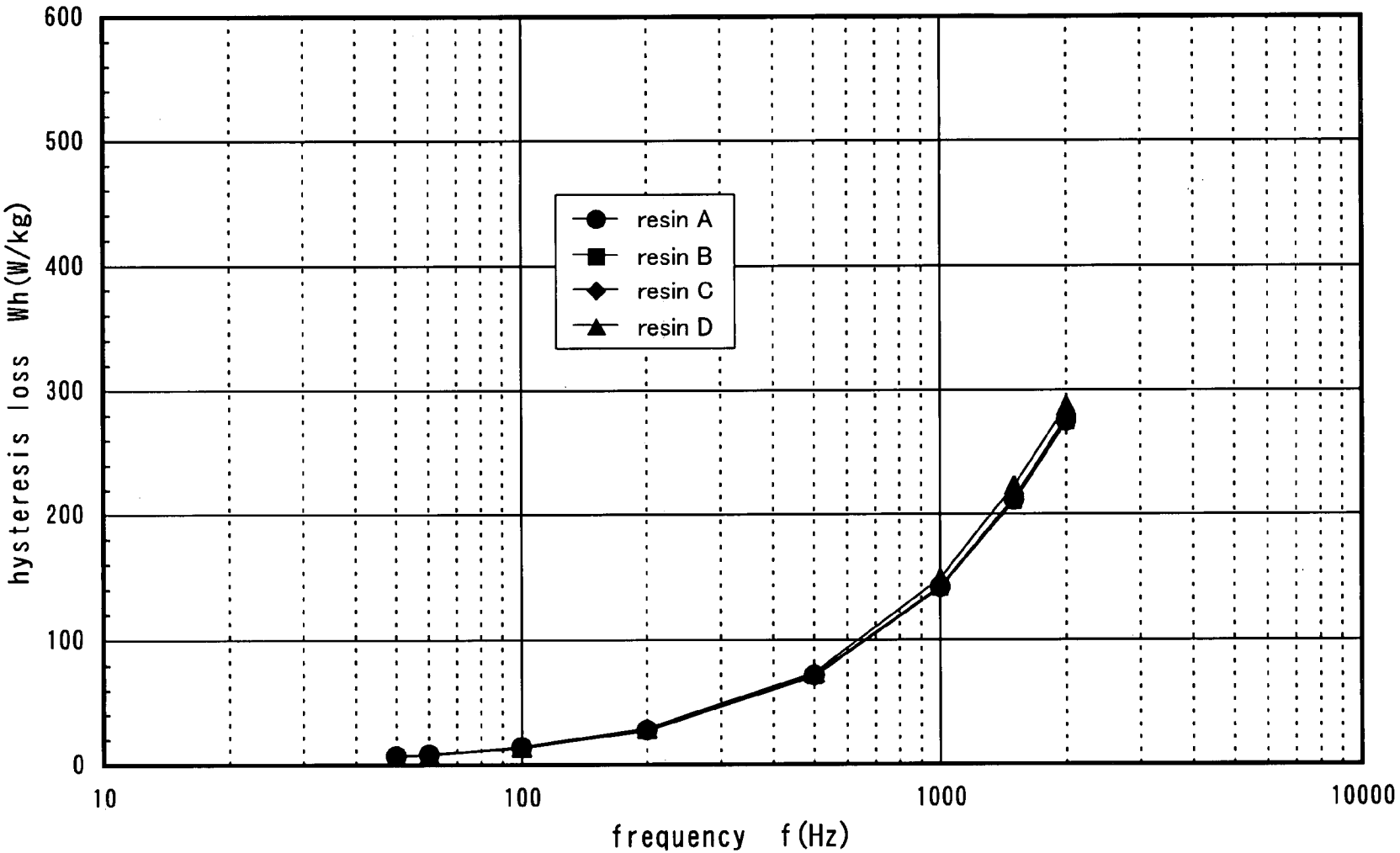
FIG. 3 is a graph showing relationships between hysteresis loss $W_h$ and frequency f concerning powdered cores produced by adding the 4 kinds of resins A to D described in the FIG. 1 to electrically insulated iron powder.
Figure 4:
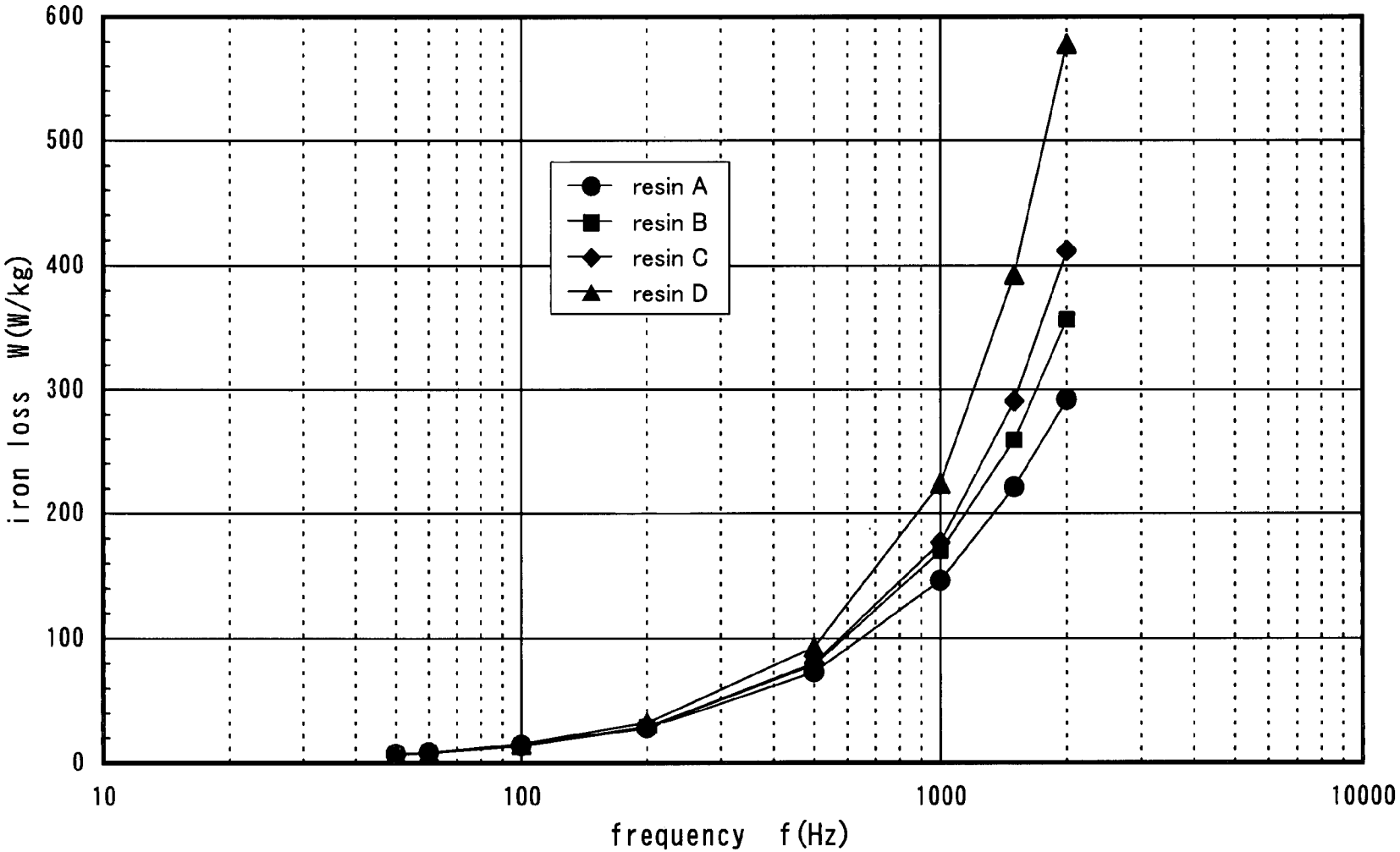
FIG. 4 is a graph showing relationships between iron loss W and frequency f concerning powdered cores produced by adding the 4 kinds of resins A to D described in the FIG. 1 to electrically insulated iron powder.
Figure 5A:
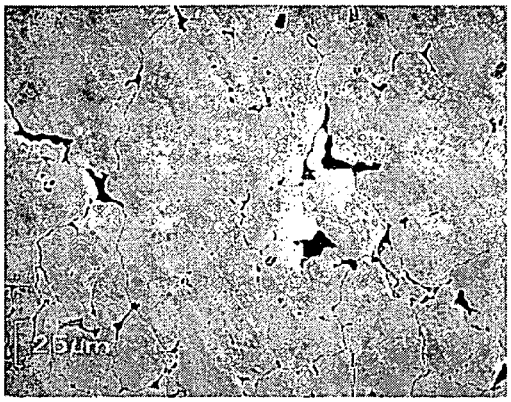
FIG. 5A is a SEM image of a practical example.
Figure 5B:
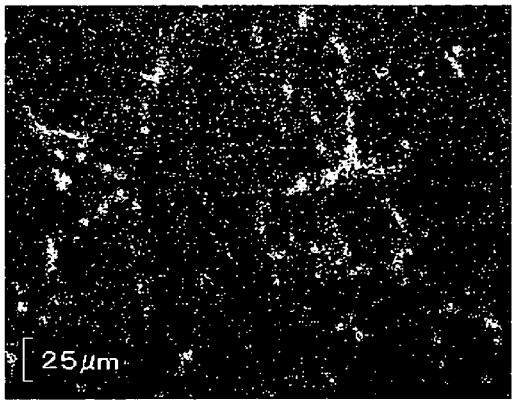
FIG. 5B is an EPMA image of a practical example.
Figure 5C:
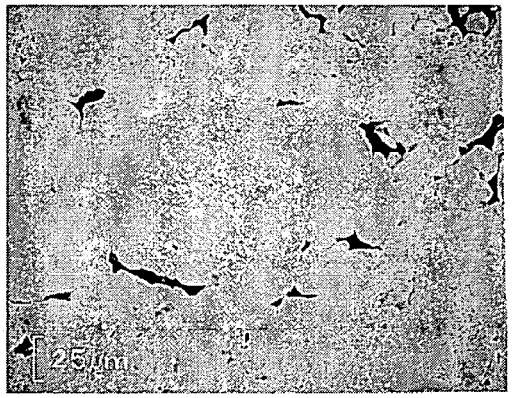
FIG. 5C is a SEM image of a conventional example.
Figure 5D:
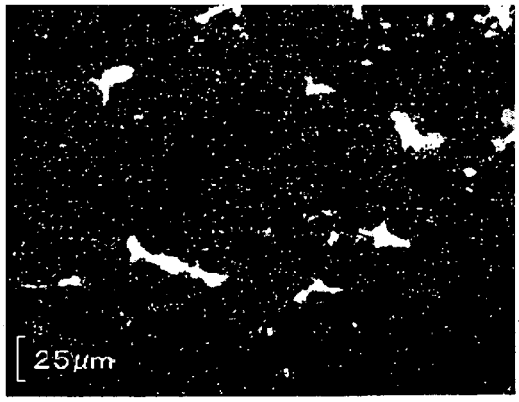
FIG. 5D is an EPMA image of a conventional example.

As shown in the Table 1 and FIGS. 2 to 4, when the median size of the resin particles is smaller, the decreasing effect of the eddy-current loss $W_e$ is larger even in the high frequency area, whereby iron loss W is further decreased. As shown in distribution condition of the carbon (resin) in the FIGS. 5A to 5D, in the Conventional Example having large median size, the carbon is nonunifiormly disposed in pores of the powdered core (see FIGS. 5C and 5D). On the other hand, in the Invention Example having small median size, the carbon is distributed not only in the pores but also along the particle boundary of the powder (see FIGS. 5A and 5B). In the Invention Example, the electrical insulation between the iron powder particles is sufficiently assured, whereby the eddy-current loss $W_e$ is decreased even in the high frequency area, resulting in decreasing the iron loss W. As mentioned above, it is demonstrated that, by using a resin having a median size of not more than 50 μm, the electrical insulation can be increased by sufficiently disposing the resin between iron powder particles, whereby the eddy-current loss $W_e$ is sufficiently decreased even in the high frequency area, resulting in sufficiently decreasing the iron loss W.

PRACTICAL EXAMPLE 2

4 kinds of resins A to D were added in various amounts to an electrically insulated iron powder coated with phosphate, and 4 kinds of resins A to D were added in various amounts to a pure iron powder in which an insulation treatment is not performed. After the addition, the resins and iron powders were mixed to respectively produce the mixtures. By using these mixtures, a green compact having a ring shape in which the inner diameter was 20 mm, the outer diameter was 30 mm, and the height was 5 mm, and a green compact having a plate shape in which vertical size was 12.7 mm, horizontal size was 31.75 mm and thickness was 5 mm were obtained at a compacting pressure of 980 MPa. These green compacts were heated and held at 200° C. for 5 hours, whereby powdered cores were produced.

In the powdered cores having the ring shape among the powdered cores as produced above, the resistivity was measured by a 4 point probe method, and the magnetic flux density was measured in a range of a magnetizing force of 10000 A/m. In the powdered cores having the plate shape in the powdered cores as produced above, a bend strength was measured by a three point bending test. The result of the resistivity is shown in Table 2, the result of the magnetic flux density is shown in Table 3, and the result of the bend strength is shown in Table 4.

each powdered core, when the resin amount is larger, the resistivity is higher. In the powdered core obtained by using a resin D (Conventional Example) having a large median size, even if the resin is added at 5.75 vol %, the resistivity is 110 μOm which is extremely low. Accordingly, when the resin having a small median size is used, a effect equal to the case of using the resin having a large median size can be obtained with an extremely small amount of resin. Even if the ordinary pure iron powder is used without using an iron powder coated with an expensive phosphate, a higher resistivity compared with a resistivity in the case of mixing the iron powder conducting the insulation coating treatment and the conventional resin (a rein having large median size) is obtained by adding a small amount of the resin having the small median size.

TABLE 2

| measured | | resin amount (vol %) | | | | | | | |
|---|---|---|---|---|---|---|---|---|---|
| characteristic | resin type | 0.00 | 0.01 | 0.85 | 1.75 | 2.65 | 3.50 | 5.00 | 5.75 |
| resistivity (μΩm) | resin A + electrically insulated iron powder | 20 | 78 | 4,126 | 5,547 | 24,667 | 82,832 | 142,300 | 176,588 |
| | resin B + electrically insulated iron powder | 20 | 31 | 747 | 1,593 | 2,399 | 5,578 | 7,610 | 9,734 |
| | resin D + electrically insulated iron powder | 20 | 22 | 30 | 50 | 71 | 88 | 98 | 110 |
| | resin A + pure iron powder | 3 | 4 | 135 | 270 | 350 | 413 | 500 | 577 |

TABLE 3

| Measured | | resin amount (vol %) | | | | | | | |
|---|---|---|---|---|---|---|---|---|---|
| characteristic | resin type | 0.00 | 0.01 | 0.85 | 1.75 | 2.65 | 3.50 | 5.00 | 5.75 |
| magnetic flux density $B_{10000A/m}$ (T) | resin A + electrically insulated iron powder | 1.76 | 1.76 | 1.69 | 1.64 | 1.60 | 1.56 | 1.50 | 1.44 |

TABLE 4

| measured | | resin amount (vol %) | | | | | | | |
|---|---|---|---|---|---|---|---|---|---|
| characteristic | resin type | 0.00 | 0.01 | 0.85 | 1.75 | 2.65 | 3.50 | 5.00 | 5.75 |
| bend strength (MPa) | resin A + electrically insulated iron powder | 53.85 | 57.30 | 67.20 | 94.72 | 107.31 | 117.04 | 117.30 | 117.53 |
| | resin B + electrically insulated iron powder | 54.56 | 56.10 | 61.80 | 62.53 | 71.74 | 83.00 | 95.60 | 105.11 |
| | resin D + electrically insulated iron powder | 52.78 | 54.00 | 60.50 | 62.74 | 66.60 | 74.16 | 76.30 | 79.08 |

As shown in Table 2, in each powdered core, when the resin amount is 0.01 vol %, an increase in the resistivity was observed in comparison with a case of adding no resin. In As shown in Table 4, when the resin amount is increased, bend strength is increased in each powdered core. The increasing effect appears more extremely when the median size of the resin is smaller. As shown in the Table 3, when the resin amount is larger, the magnetic flux density is lower. When the resin amount exceeds at 5 vol %, the magnetic flux density is less than 1.5 T. When the powdered core is used as an electric component and core for various motors, a characteristic of not less than 1.5 T is required, whereby an addition of the resin at not less than 5 vol % is not preferable. As mentioned above, when the resin amount is not less than 0.01 vol %, an increase in the resistivity is observed. When the resin amount is more than 5 vol %, the magnetic flux density is decreased. Accordingly, the resin amount is preferably 0.01 to 5 vol %.

PRACTICAL EXAMPLE 3

A thermosetting polyimide resin having a median size of 1, 4, 14, 25, or 50 μm was added at 0.03 to 0.4 mass % (0.18 to 2.4 vol %) to an electrically insulated iron powder (particle size: 100 mesh under size) coated with phosphate, and the resin and the iron powder were mixed, whereby a mixture was respectively obtained. These mixtures were compacted at a compacting pressure of 1470 MPa to obtain green compacts having a ring shape in which the inner diameter was 10 mm, the outer diameter was 23 mm, and the height was 5 mm, and these green compacts were heated and held at 200° C. for 2 hours in air, whereby powdered cores was respectively produced. When the compacting is performed, a compacting die assembly was heated at 150° C., a lubricant powder for compacting was electrostatically applied to inner surface of the die, and the compacting die assembly was filled with heated mixture. A median size of the resin powder was measured by a laser diffraction type of measuring device for amount of particles.

By using each of the powdered cores having the ring shape as produced above, a magnetic flux density in a magnetic field of 8000 A/m was measured, iron loss in a exciting magnetic flux density of 0.25 T and in a frequency of 5 kHz was measured, and resistivity was measured by 4-probe method.

Figure 6:
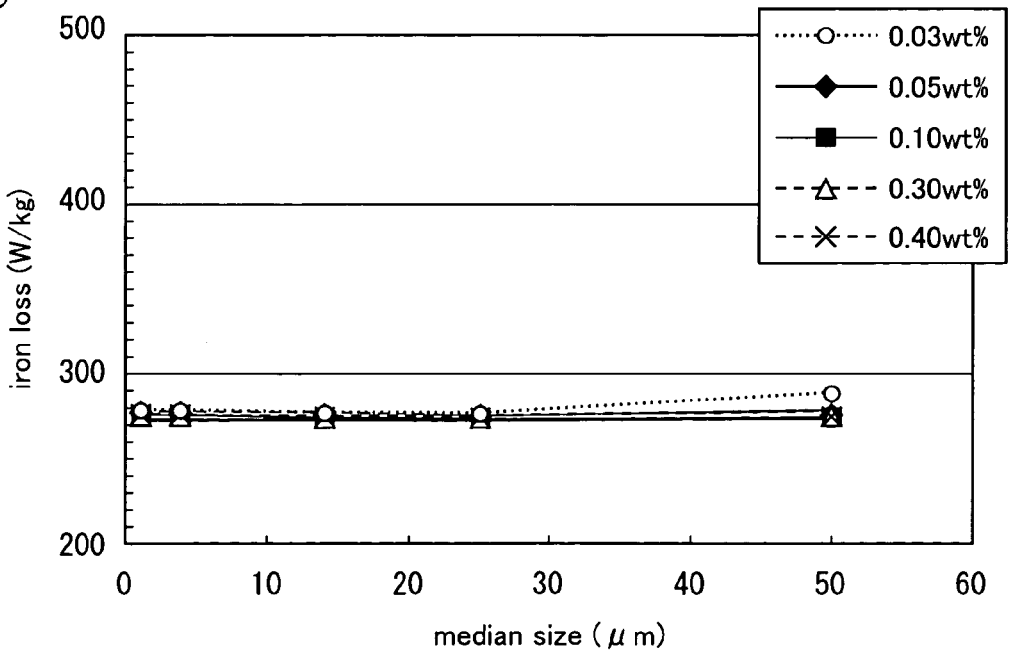
FIG. 6 is a graph showing relationships between iron loss and median size in the various resin amounts as described in the following Practical Example 3 of the present invention.
Figure 7:
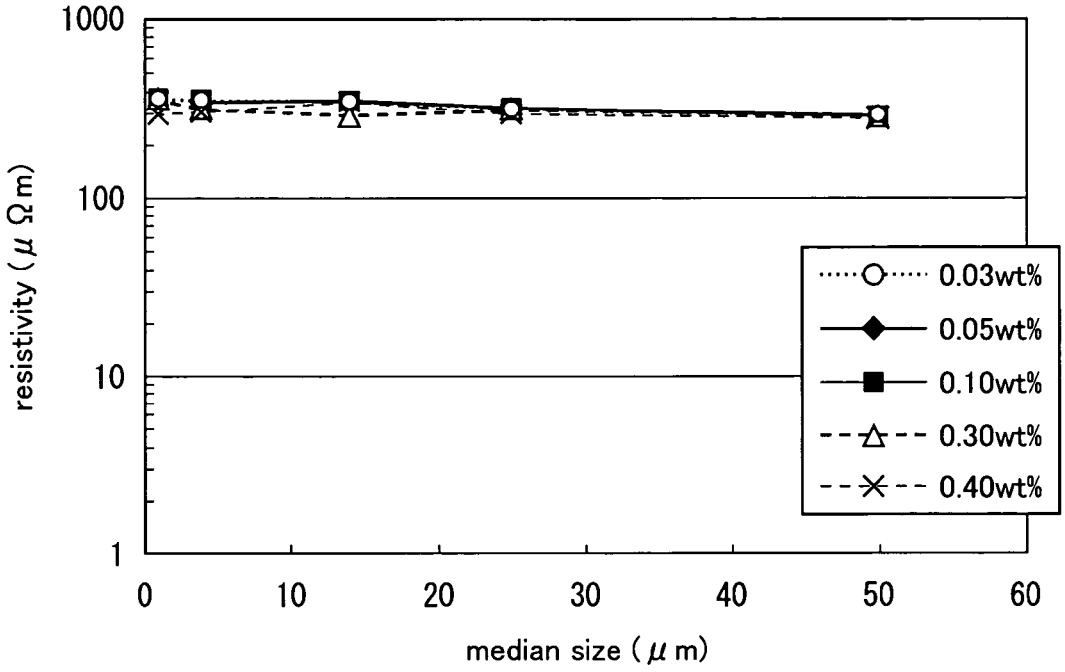
FIG. 7 is a graph showing relationships between resistivity and median size in the various resin amounts as described in the following Practical Example 3 of the present invention.
Figure 8:
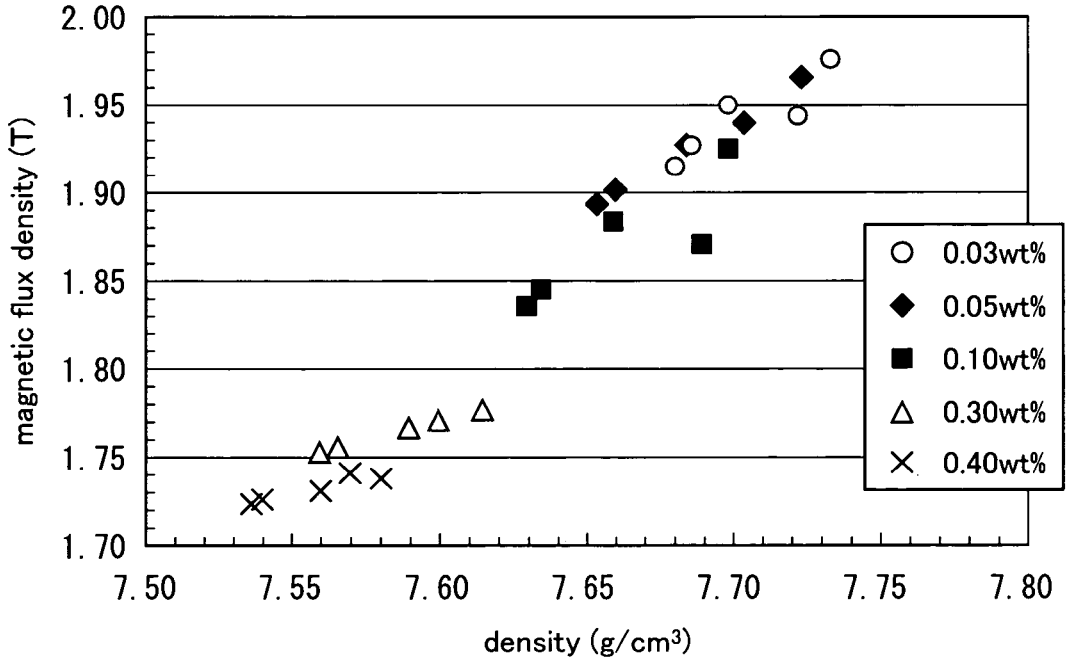
FIG. 8 is a graph showing relationships between magnetic flux density and density of powdered cores in the various resin amounts as described in the following Practical Example 3 of the present invention.

The relationship between iron loss and median size in the various resin amounts (mass %) is shown in FIG. 6, the relationship between the resistivity and the median size in the various resin amounts (mass %) is shown in FIG. 7, and a relationship between a magnetic flux density and a density of powdered cores in the various resin amounts is shown in FIG. 8. The amounts of the resin are shown by mass % in these figures.

As shown in FIG. 6 and FIG. 7, in any powdered core in which a median size of the thermosetting polyimide resin powder is not more than 50 μm, the iron loss and the resistivity are approximately equal in a range of the resin amount of 0.03 to 0.4 mass %. Accordingly, it was found that low iron loss can be obtained in the case of setting the resin amount to be not less than 0.03 mass % (0.18 vol %).

As shown in FIG. 8, the magnetic flux density depends on the density of the powdered core. When the resin amount is small, the density is high. When the resin amount is large, the magnetic flux density is low. In the powdered core requiring high magnetic attraction power as a solenoid core, the magnetic flux density is preferably not less than 1.75 T. As shown in FIG. 8, resin amounts corresponding to the value of the magnetic flux density are not more than 0.3 mass % (1.8 vol %). However, when a compacting pressure is further increased, the magnetic flux density of not less than 1.75 T can be obtained even if the resin amount is 0.4 mass % (2.4 vol %).

According to the above-mentioned findings, in using thermosetting polyimide resin as a resin powder, it is preferable that the resin amount be 0.03 to 0.4 mass % (0.18 to 2.4 vol %) in the case of setting the median size to be not more than 50 μm, and it is more preferable that 0.03 to 0.3 mass % (0.18 to 1.8 vol %) in that case.

PRACTICAL EXAMPLE 4

A thermoplastic polyimide resin having a median size of 1, 3, 13, 20, or 50 μm (which was measured by a laser diffraction type of measuring device for amount of particles) was added at 0.03 to 0.4 mass % (0.18 to 2.4 vol %) to an electrically insulated iron powder (particle size: 100 mesh under size) coated with phosphate, and the resin and the iron powder were mixed, whereby a mixture was respectively obtained. These mixtures were compacted at a compacting pressure of 1470 MPa to obtain green compacts having a ring shape in which the inner diameter was 10 mm, the outer diameter was 23 mm, and the height was 5 mm, and these green compacts were heated and held at 400° C. for 1 hour in nitrogen gas, whereby powdered cores were produced. When the compacting is performed, a compacting die assembly was heated at 150° C., a lubricant powder for compacting was electrostatically applied to inner surface of the die, and the compacting die assembly was filled with heated mixture.

By using each of the powdered cores having the ring shape as produced above, a magnetic flux density and an iron loss were measured in the same manner as in the Practical Example 3.

Figure 9:
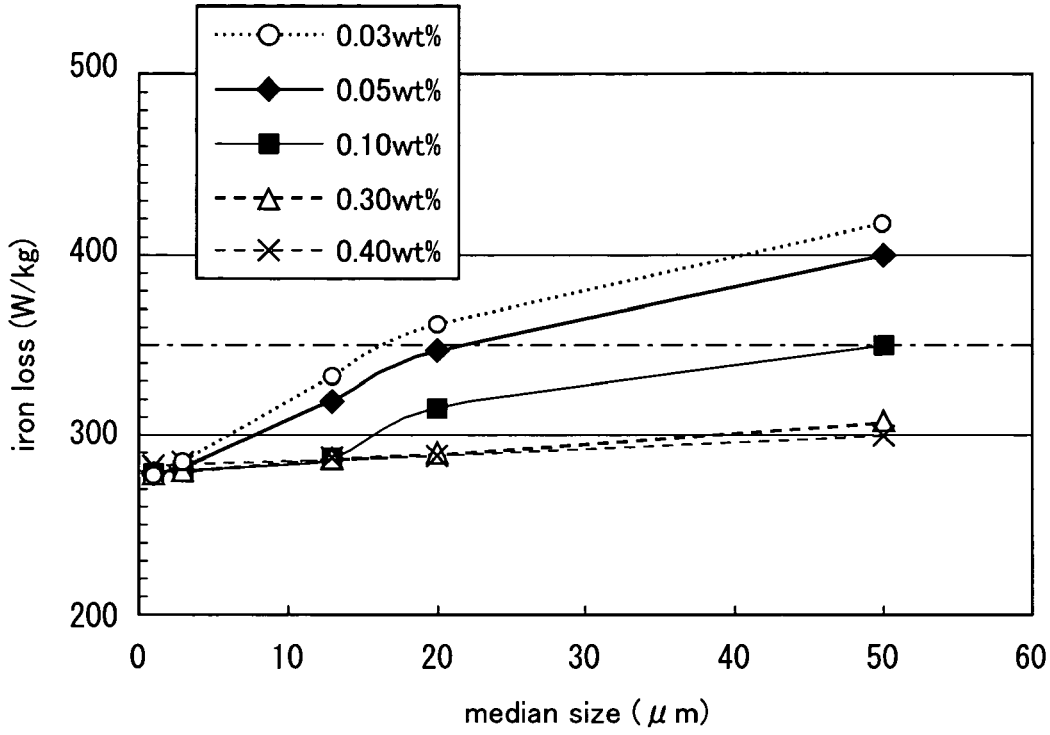
FIG. 9 is a graph showing relationships between iron loss and median size in the various resin amounts as described in the following Practical Example 4 of the present invention.
Figure 10:
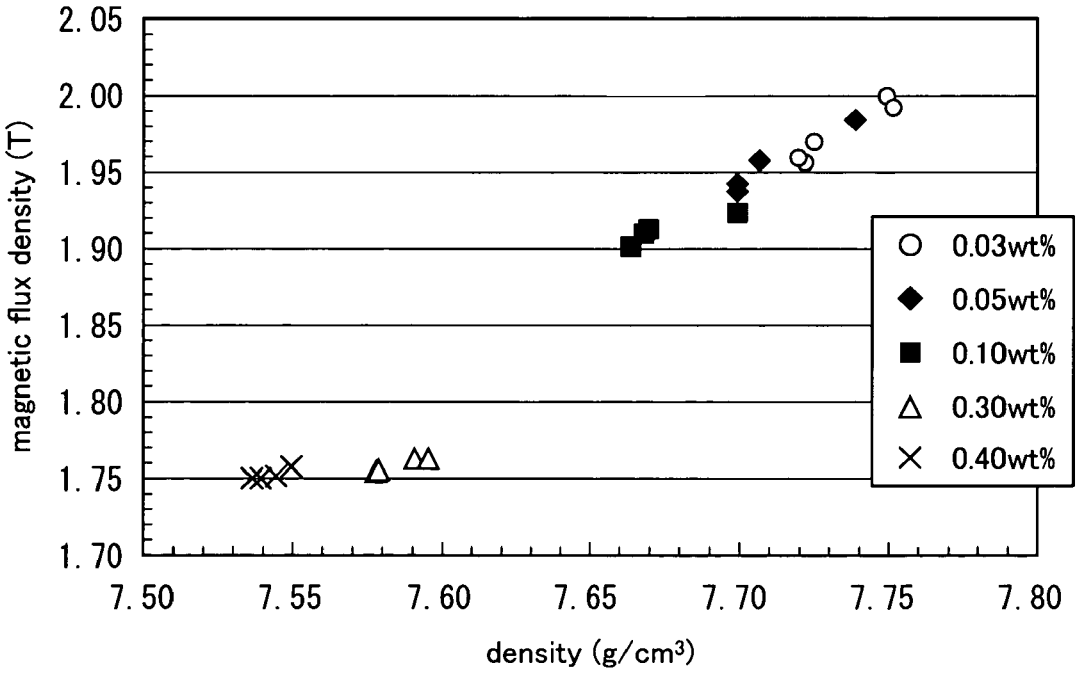
FIG. 10 is a graph showing relationships between magnetic flux density and density of powdered cores in the various resin amounts as described in the following Practical Example 4 of the present invention.

The relationship between iron loss and median size in the various resin amounts (mass %) is shown in FIG. 9, and the relationship between magnetic flux density and density of the powdered cores is shown in FIG. 10. The resin amounts are shown by mass % in these figures.

As shown in the FIG. 9, when the median size is smaller, the iron loss is lower, whereby the resistivity is higher. In the powdered cores in which a resin amount is 0.3 mass % (1.8 vol %) and 0.4 mass % (2.4 vol %), the iron loss is lower than that of any other powdered core. As shown in FIG. 9, when the preferable value of the iron loss is set to be not more than 350 W/kg, it is preferable that the median size be not more than 50 μm in the case of setting the resin amount to be not less than 0.1 mass % (0.59 vol %), and that the median size be not more than 13 μm in the case of setting the resin amount to be 0.03 to 0.05 mass % (0.18 to 0.3 vol %).

As shown in FIG. 10, the magnetic flux density depends on the density of the powdered core. When the resin amount is small, the magnetic flux density is high. When the resin amount is large, the magnetic flux density is low. In each powdered core, the magnetic flux density of not less than 1.75 T can be obtained when the median size is not more than 50 μm and the resin amount is not more than 0.4 mass % (2.4 vol %).

According to the above-mentioned findings, in using thermoplastic polyimide resin as a resin powder, it is found that the resin amount is preferably 0.1 to 0.4 mass % (0.59 to 2.4 vol %) in the case of setting the median size to be not more than 50 μm, and that the resin amount is preferably 0.03 to 0.4 mass % (0.18 to 2.4 vol %) in the case of setting the median size to be not more than 13 μm. It was found that a resin having a median size of not more than 13 μm is more preferably used, and the resin amount is more preferably not more than 0.1 mass % (not more than 0.59 vol %) in order to obtain a powdered core having high magnetic flux density and low iron loss.

PRACTICAL EXAMPLE 5

A polytetrafluoroethylene having a median size of 0.12, 3, or 10 μm (which was measured by a laser diffraction type of measuring device for amount of particles) was added at 0.03 to 0.4 mass % (0.11 to 1.4 vol %) to an electrically insulated iron powder (particle size: 100 mesh under size) coated with phosphate, and the polytetrafluoroethylene and the iron powder were mixed, whereby a mixture was respectively obtained. These mixtures were compacted at a compacting pressure of 1470 MPa to obtain green compacts having a ring shape in which the inner diameter was 10 mm, the outer diameter was 23 mm, and the height was 5 mm, and these green compacts were heated and held at 340° C. for 1 hour in nitrogen gas, whereby powdered core was respectively produced. When the compacting is performed, a compacting die assembly was heated at 150° C., a lubricant powder for compacting was electrostatically applied to an inner surface of the die, and the compacting die assembly was filled with heated mixture.

By using the each powdered cores having the ring shape as produced above, a magnetic flux density and an iron loss were measured in the same manner as in the Practical Example 3.

Figure 11:
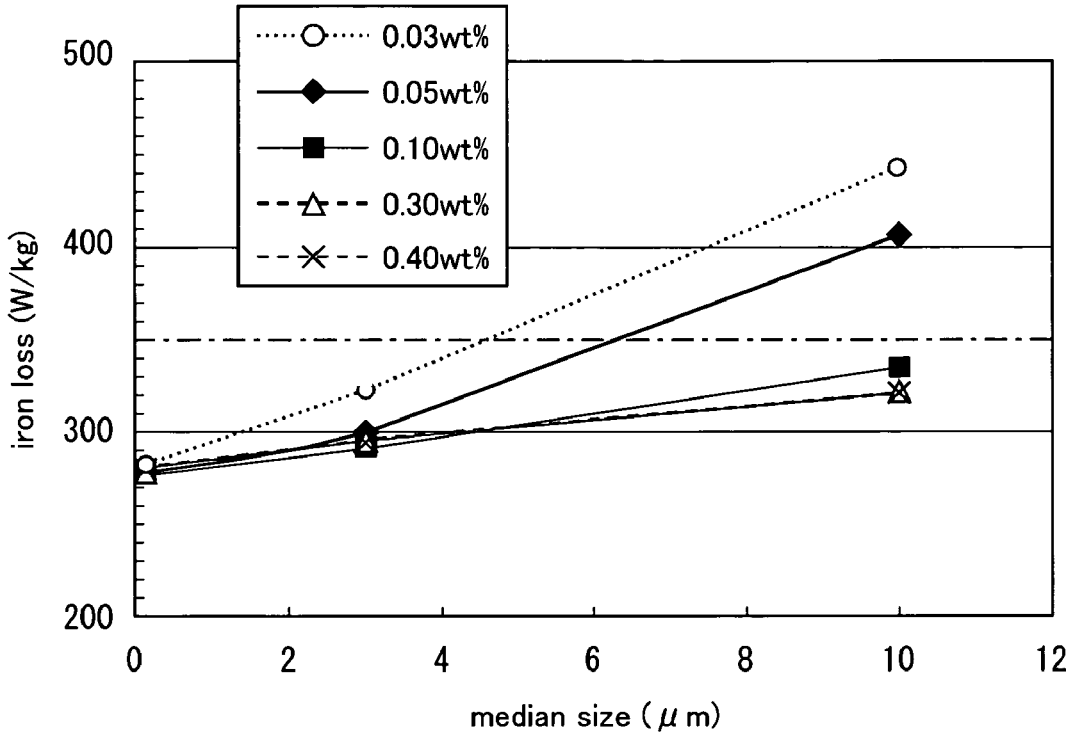
FIG. 11 is a graph showing relationships between iron loss and median size in the various resin amounts as described in the following Practical Example 5 of the present invention.
Figure 12:
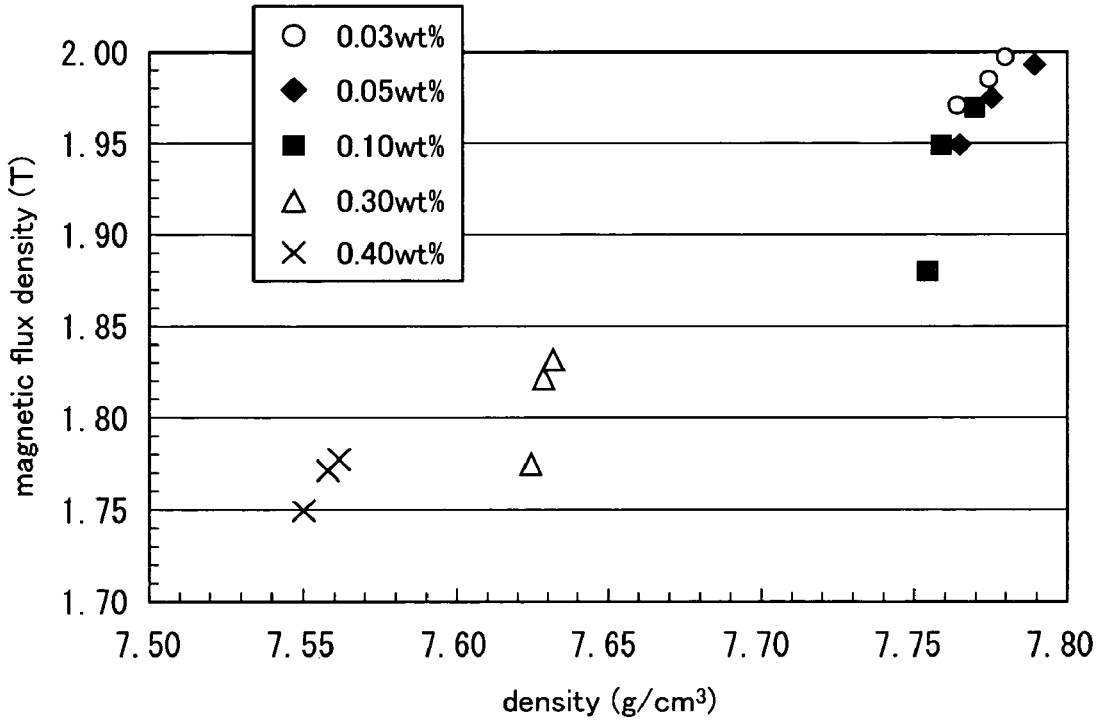
FIG. 12 is a graph showing relationships between magnetic flux density and density of powdered cores in the various resin amounts as described in the following Practical Example 5 of the present invention.

The relationship between iron loss and median size in the various resin amounts (mass %) is shown in FIG. 11, and the relationship between magnetic flux density and density of the powdered core is shown in FIG. 12. The resin amounts are shown by mass % in these figures.

As shown in the FIG. 11, when the median size of the polytetrafluoroethylene powder is not more than 3 μm, the iron loss can be suppressed at a low value of about not more than 300 W/kg, and when the median size is not more than 5 μm, the iron loss can be suppressed at about not more than 350 W/kg. In the powdered cores in which a resin amount is 0.03 mass % (0.11 vol %) and 0.05 mass % (0.18 vol %), when the median size is larger, the iron loss is higher than that of any other powdered core.

As shown in FIG. 12, the magnetic flux density depends on the density of the powdered core. When the resin amount is small, the magnetic flux density is high. When the resin amount is large, the magnetic flux density is low. In the every powdered core, a magnetic flux density of not less than 1.75 T can be obtained when the median size is not more than 10 μm and the resin amount is not more than 0.4 mass % (1.4 vol %).

According to the above-mentioned findings, in using polytetrafluoroethylene as a resin powder, it is found that the resin amount is preferably 0.1 to 0.4 mass % (0.36 to 1.4 vol %) in the case of setting the median size to be not more than 10 μm, and that the resin amount is preferably 0.03 to 0.4 mass % (0.11 to 1.4 vol %) in the case of setting the median size to be not more than 5 μm. It was found that a fine powder having a median size of about 0.1 to 3 μm is more preferably used, and the resin amount is more preferably not more than 0.1 mass % (0.36 vol %).

PRACTICAL EXAMPLE 6

Powdered cores were produced in the same manner of the Practical Example 3 to 5 except setting the compacting pressure to be 1470 MPa. The obtained powdered core was respectively cut by a lathe. In any of the powdered cores, no defect in the chucking by the lathe and the cutting work occurred. Although the powdered core produced of only iron powder and not including a resin had a gloss on the cutting surface, long chips were formed, whereby iron as a material of the powdered core is easily adhered on the cutting edge of the bit, resulting in rapidly galling of the bit. In contrast, in the powdered core including the polyimide resin, the chips were short, whereby the bit galling was decreased, and when the polyimide resin amount was larger, bit life was longer. In the powdered core including the polytetrafluoroethylene, the chips were finer, whereby the bit durability was improved. According to the above-mentioned result, cutting work of the contour, a groove machining, and a punching by a drill can be performed on the powdered cores including polyimide resin or polytetrafluoroethylene.

In the powdered cores obtained by production methods of the present invention, the special treatment, for example, insulation coating treatment by resin, is not necessary, whereby a low production cost can be realized. Since electrical insulation is increased by uniformly disposing the resin between soft magnetic powder particles, the eddy-current loss $W_e$ in a high frequency area and heat generation caused by the $W_e$ are decreased, thereby improving the durability of the powdered core and improving performance of products using the powdered core. Since magnetic flux density is sufficiently assured by thinly disposing the resin between the soft magnetic powder particles, the hysteresis loss $W_h$ and heat generation caused by the $W_h$ are decreased, thereby further improving the durability of the powdered core and further improving performance of products using the powdered core. In the case of coating an insulation film over the surface of the soft magnetic powder, the electrical insulation is ensured to be at a higher level and the magnetic flux density is further increased by decreasing the resin amount used, whereby a powdered core in which the durability is further improved and the technical advantages are further expanded can be provided. Therefore, the present invention is anticipated to be able to produce powdered cores suitable for various magnetic components.

The invention claimed is:

1. A method for producing a powdered core, comprising:

preparing a mixture comprising a soft magnetic powder and a resin powder;

compacting the mixture into a predetermined shape to obtain a green compact; and heating the green compact;

wherein:

the resin powder has a median size of not more than 50 μm, and the resin powder amount is 0.01 to 2.65% by volume; and the resin powder is a thermosetting polyimide resin or a polytetrafluoroethylene resin.

2. The method according to claim 1, wherein the resin powder is a thermosetting resin with a median size of 30 μm or less.

3. The method according to claim 1, wherein the thermosetting polyimide resin powder amount is 0.18 to 2.4 vol %.

4. The method according to claim 1, wherein the polytetrafluoroethylene resin amount is 0.36 to 1.4 vol % when the median size is not more than 10 μm, and is 0.11 to 1.4 vol % when the median size is not more than 5 μm.

5. The method according to claim 1, wherein the soft magnetic powder is an iron powder having a surface coated with a phosphate compound, the mixture is compacted with a compacting pressure of 700 to 2000 MPa to obtain a green compact, the green compact is subjected to a heating treatment; and it is machined to have a predetermined shape.

6. The method according to claim 5, wherein the compacting is performed by applying a lubricant powder for compacting to an inner surface of a compacting die assembly without adding a lubricant powder for compacting to the mixture.

7. A method for producing a solenoid core for an engine fuel injection device, comprising:

preparing a mixture according to claim 1; and compacting the mixture with a compacting pressure of 1000 to 2000 MPa to obtain a green compact with a cylindrical shape;

wherein the green compact is subjected to a heating treatment and it is machined to have a predetermined shape.

* * * * *